US005142308A

United States Patent [19]

Hasegawa et al.

[11] Patent Number: 5,142,308

[45] Date of Patent: Aug. 25, 1992

[54] INK JET HEAD HAVING HEAT GENERATING RESISTOR MADE OF NON-SINGLE CRYSTALLINE SUBSTANCE CONTAINING IR AND TA

[75] Inventors: Kenji Hasegawa; Atsushi Shiozaki; Isao Kimura, all of Kawasaki; Kouichi Touma, Tachikawa, all of Japan

[73] Assignee: Canon Kabushiki Kaisha, Tokyo, Japan

[21] Appl. No.: 598,707

[22] PCT Filed: Feb. 28, 1990

[86] PCT No.: PCT/JP90/00257

§ 371 Date: Oct. 25, 1990

§ 102(e) Date: Oct. 25, 1990

[87] PCT Pub. No.: WO90/09888

PCT Pub. Date: Sep. 7, 1990

[30] Foreign Application Priority Data

Feb. 28, 1989 [JP] Japan ..... 1-46769

[51] Int. Cl.[5] ..... B41J 2/05

[52] U.S. Cl. ..... 346/140 R; 338/308

[58] Field of Search ..... 346/140, 76 PH; 338/308

[56] References Cited

U.S. PATENT DOCUMENTS

| | | | |
|---|---|---|---|
| 3,833,410 | 9/1974 | Ang | 338/308 X |
| 4,313,124 | 1/1982 | Hara | 346/140 R |
| 4,335,389 | 6/1982 | Shirato et al. | 346/140 R |
| 4,345,262 | 8/1982 | Shirato et al. | 346/140 R |
| 4,429,321 | 1/1984 | Matsumoto | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |

FOREIGN PATENT DOCUMENTS

| | | |
|---|---|---|
| 56847 | 5/1979 | Japan . |
| 90376 | 7/1980 | Japan . |
| 126462 | 9/1980 | Japan . |
| 132267 | 10/1980 | Japan . |
| 40565 | 4/1981 | Japan . |
| 72867 | 5/1982 | Japan . |
| 96971 | 6/1984 | Japan . |
| 123670 | 7/1984 | Japan . |
| 135169 | 8/1984 | Japan . |
| 138461 | 8/1984 | Japan . |
| 67163 | 4/1985 | Japan . |
| 71260 | 4/1985 | Japan . |
| 33790 | 2/1987 | Japan . |
| 280340 | 12/1987 | Japan . |

*Primary Examiner*—Joseph W. Hartary

*Attorney, Agent, or Firm*—Fitzpatrick, Cella, Harper & Scinto

[57] ABSTRACT

An ink jet head is provided which includes an electrothermal converting body having a heat generating resistor which generates, upon energization, heat energy to be directly applied to ink on a heat acting face to discharge the ink. The ink jet head is characterized in that the heat generating resistor is formed from a non-single crystalline substance substantially composed of Ir and Ta and containing the Ir and Ta at the following respective composition rates:

35 atom percent $\leqq$ Ir $\leqq$ 77 atom percent, and 23 atom percent $\leqq$ Ta $\leqq$ 65 atom percent.

26 Claims, 4 Drawing Sheets

INK JET HEAD HAVING HEAT GENERATING RESISTOR MADE OF NON-SINGLE CRYSTALLINE SUBSTANCE CONTAINING IR AND TA

FIELD OF THE INVENTION

This invention relates to an ink jet head and an ink jet apparatus which include an electrothermal converting body which is superior in resisting property to a shock of a cavitation (hereinafter referred to as "cavitation resisting property"), resisting property to erosion by a cavitation (hereinafter referred to as "cavitation resisting property"), chemical stability, electrochemical stability, oxidation resisting property, dissolution resisting property, heat resisting property, thermal shock resisting property, mechanical durability and so forth. A representative one of such ink jet heads and ink jet apparatus includes an electrothermal converting body having a heat generating resistor which generates, when energized, heat energy which is to be directly applied to ink on a heat acting face to cause the ink to be discharged. Then, such electrothermal converting body is low in power consumption and superior in responsibility to an input signal.

BACKGROUND OF THE INVENTION

An ink jet system (in particular, a bubble jet system) disclosed in U.S. Pat. No. 4,723,129, U.S. Pat. No. 4,740,796 and so forth can provide high speed, high density and high definition recording of a high quality and is suitable for color recording and also for compact designing. Accordingly, progressively increasing attention has been paid to such ink jet system in recent years. In a representative one of apparatus which employ such system, ink (recording liquid or the like) is discharged making use of heat energy, and accordingly, it has a heat acting portion which causes heat to act upon the ink. In particular, a heat generating resistor having a heat acting portion is provided for an ink pathway, and making use of heat energy generated from the heat generating resistor, ink is heated suddenly to produce an air bubble by which the ink is discharged.

The heat acting portion has, from a point of view of causing heat to act upon an object, a portion apparently similar in construction to a conventional so-called thermal head. However, the heat acting portion is quite different in fundamental technology from a thermal head in such points that it contacts directly with ink, that it is subjected to a mechanical shock which is caused by cavitations produced by repetitions of production and extinction of bubbles of ink, or in some cases, further to erosion, that it is subjected to a rise and a drop of temperature over almost 1,000° C. for a very short period of time of the order of $10^{-1}$ to 10 microseconds, and so forth. Accordingly, the thermal head technology cannot naturally be applied to the bubble jet technology as it is. In other words, the thermal head technology and ink jet technology cannot be argued on the same level.

By the way, as for a heat acting portion of an ink jet head, since it is subjected to such severe environment as described above, it is a common practice to employ such a structure that an electric insulating layer made of, for example, $SiO_2$, SiC, $Si_3N_4$ or the like is provided as a protective film on a heat generating resistor and a cavitation resisting layer made of Ta or the like is provided further on the electric insulating layer in order to protect the heat acting portion from environment in which it is used. As composing materials of such protective layer for use with an ink jet head, such materials which are tough against a shock and erosion by a cavitation as are described, for example, in U.S. Pat. No. 4,335,389 can be cited. It is to be noted that an abrasion resisting layer made of $Ta_2O_5$ or the like popularly used for a thermal head is not always superior in cavitation resisting property.

Apart from this, it is desired for a heat acting portion of an ink jet head to be constituted such that heat generated from a heat generating resistor acts upon ink as efficiently and quickly as possible in order to save power consumption and improve the responsibility to an input signal. To this end, apart from the aforementioned form in which a protective layer is provided, also a form in which a heat generating resistor contacts directly with ink is proposed in Japanese Patent Laid-Open No. 126462/1980.

A head of the form is superior with regard to thermal efficiency to the form in which a protective layer is provided. However, not only a heat generating resistor is sujected to a shock or erosion by a cavitation and further to a rise and a drop of temperature, but also it is subjected to an electrochemical reaction which is caused by electric current which flows through recording liquid because the recording liquid which contacts with the heat generating resistor has an electric conductivity. Consequently, various metals, alloys, metallic compounds or cermets beginning with $Ta_2N$ and $RuO_2$ which are conventionally known as materials of heat generating resistors are not always satisfactory in durability or stability for an application to a heat generating resistor of a head of the form.

While some of ink jet heads of the form wherein a protective layer is provided as described above which have been proposed so far can be adopted in practical use as regards durability and resistance variation, it is very difficult, in any case, to perfectly prevent occurrence of defects which may take place upon formation of a protective layer, which is a serious factor of deteriorating the yield in mass production. Then, further improvement in speed and density in recording is demanded, and since there is a tendency that the number of discharging outlets of a head is increased corresponding to such demand, this is a serious problem.

Further, while a protective layer described above decreases the efficiency in transfer of heat from a heat generating resistor to recording liquid, if the heat transfer efficiency is low, then the entire power consumption required increases and the temperature variation of the head upon driving increases. Such temperature variation results in volume variation of a droplet discharged from a discharging outlet, which causes a variation in density of an image. Meanwhile, if the number of discharging operations per unit time is increased in order to cope with an increase in recording speed, the power consumption by the head is increased accordingly and the temperature variation is increased. Such temperature variation will bring about a corresponding density variation of an image obtained. Also when an increase in number of discharging outlets which involves an increase in density of electrothermal converting bodies, the power consumption by the head increases, and a temperature variation by such increase in power consumption will likewise cause an image obtained to have a density variation corresponding to such temperature variation. Such problem that an image obtained has a density variation is contrary to a demand for a high quality of a recorded image and is required to be solved as early as possible.

In order to solve such problem, provision is desired earnestly of an ink jet head wherein a heat generating resistor contacts directly with ink and the heat efficiency is high.

However, since a heat generating resistor of an ink jet head of the conventional form wherein ink contacts directly with the heat generating resistor is subjected not only to a shock or erosion by a cavitation and further to a rise and a drop of temperature but also to an electrochemical reaction as described hereinabove, conventional materials for a heat generating resistor such as $Ta_2N$, $RuO_2$ or $HfB_2$ have a problem in durability in that the heat generating resistor may be mechanically destroyed, or corroded or dissolved.

The materials which are disclosed as tough against a shock or erosion by a cavitation in U.S. Pat. No. 4,335,389 and so forth do not exhibit their effects if they are not used for such a protective layer (cavitation resisting layer) as described hereinabove. However, if any of the materials is employed for a heat generating resistor which contacts directly with ink, then it is sometimes dissolved or corroded by an electrochemical reaction, and consequently, it may not assure a sufficient durability.

Further, the stability of discharging is inevitable for recording of a high definition and a high quality, and to this end, it is necessary that the resistance variation of a heat generating resistor be low, and for practical use, preferably it is lower than 5%. Ta or a Ta-Al alloy mentioned in Japanese Patent Laid-Open No. 96971/1984 is comparatively superior, where it is employed for a heat generating resistor of an ink jet heat which contacts directly with ink, in durability, that is, in cavitation resisting property in that the resistor is not broken. However, with regard to a resistor variation during a repetition of production of bubbles, Ta or a Ta-Al alloy is not satisfactory in that the resistor variation is not very small. Further, Ta or a Ta-Al alloy does not have a very high ratio M between an applied pulse voltage ($V_{break}$) at which the resistor is broken and a bubble producing threshold voltage ($V_{th}$) and is not very high in heat resisting property, and consequently, they have a problem that the life of the resistor is deteriorated significantly by a small increase of a driving voltage ($V_{op}$). In particular, Ta or a Ta-Al alloy is not always sufficiently high in resisting property to an electrochemical reaction, and consequently, where it is employed as a material for a heat generating resistor for an ink jet head which contacts directly with ink, if production of bubbles is repeated by a large number of application pulses, then the electric resistance of the heat generating resistor is varied to a great extent. Thus, there is a problem that also the condition of production of bubbles is varied by such variation of the electric resistance of the heat generating resistor. Further, there is another problem that, since the heat resisting property is not very high, a small variation of $V_{op}$ sometimes has a significant influence on the life of the resistor.

In this manner, even if a heat generating resistor which contacts with recording liquid (that is, ink) is formed from any of the conventionally known materials, an ink jet head or an ink jet apparatus cannot be obtained readily which can satisfy all of a cavitation resisting property, erosion resisting property, mechanical durability, chemical stability, electrochemical stability, resistance stability, heat resisting property, oxidation resisting property, dissolution resisting property and thermal shock resisting property.

Particularly, an ink jet head or an ink jet apparatus cannot be obtained readily which has a structure wherein a heat generating resistor is provided for direct contact with ink and is high in heat transfer efficiency, superior in signal responsibility and sufficiently high in durability and discharging stability.

SUMMARY OF THE INVENTION

It is a principal object of the present invention to provide an improved ink jet head which solves the above described problems of a conventional ink jet head of the form wherein ink contacts directly with a heat generating resistor as well as an ink jet apparatus having such improved ink jet head.

It is another object of the present invention to provide an improved ink jet head which is superior in cavitation resisting property, erosion resisting property, mechanical durability, chemical stability, electrochemical stability, resistance stability, heat resisting property, oxidation resisting property, dissolution resisting property and thermal shock resisting property and has a high thermal conductivity.

It is a further object of the present invention to provide an improved ink jet head which has a structure wherein a heat generating resistor contacts directly with recording liquid (that is, ink) and in which, even after repetitive use for a long period of time, heat energy is transmitted always stably in a high efficiency to the recording liquid rapidly in response to a signal on demand to effect discharging of the ink to produce an excellent recorded image.

It is a still further object of the present invention to provide an improved ink jet head which has a structure wherein a heat generating resistor contacts directly with recording liquid and in which the power consumption by the heat generating resistor is restricted low to minimize the temperature variation of the head and, even after repetitive use for a long period of time, discharging of ink is effected always stably to obtain an image which is free from a variation in density caused by a temperature variation of the head.

It is a yet further object of the present invention to provide an ink jet apparatus which includes such an improved ink jet head as described above.

The inventors have obtained such perception, after an energetic investigation has been made in order to solve the above described problems of a conventional ink jet head of the form wherein ink contacts directly with a heat generating resistor and achieve the objects described above, that an ink jet head which attains the objects is obtained if the heat generating resistor of the ink jet head is made of a non-single crystalline material which contains two elements of iridium (Ir) and tantalum (Ta) at a particular composition rate, and the present invention has been completed relying upon the perception.

The non-single crystalline material is an amorphous material, a polycrystalline material or a material consisting of an amorphous material and a polycrystalline material in a mixed state, which contains two elements of iridium (Ir) and tantalum (Ta) at a composition rate of 35 to 77 atom percent and 23 to 65 atom percent, respectively (these materials will be hereinafter referred to as "non-single crystalline Ir-Ta substance" or "Ir-Ta" alloy).

The inventors selected iridium (Ir) from a point of view of a substance which is high in heat resisting property and oxidation resisting property and is chemically stable and selected tantalum (Ta) from a point of view of a substance which has a mechanical strength and provides oxides which are high in dissolution resisting property to a solvent, and then produced a plurality of non-single crystalline substance samples containing the two elements at predetermined composition rates by sputtering.

The individual samples were produced by forming a film on a single crystalline Si substrate or a Si single crystalline substrate with a thermally oxidized $SiO_2$ film of 2.5 um thick formed on a surface thereof using a sputtering apparatus (commodity name: sputtering apparatus CFS-8EP, manufactured by Kabushiki Kaisha Tokuda Seisakusho) shown in FIG. 4. Referring to FIG. 4, reference numeral 201 denotes a film forming chamber. Reference numeral 202 denotes a substrate holder disposed in the film forming chamber 201 for holding a substrate 203 thereon. The substrate holder 202 has a heater (not shown) built therein for heating the substrate 203. The substrate holder 202 is supported for upward and downward movement and also for rotation by means of a rotary shaft 217 extending from a drive motor (not shown) installed outside the system. A target holder 205 for holding thereon a target for the formation of a film is provided at a position in the film forming chamber 201 opposing to the substrate 203. Reference numeral 206 denotes a Ta target formed from a Ta plate placed on a surface of the target holder 205 and having a purity of higher than 99.9 weight percent. Reference numeral 207 denotes an Ir target formed from an Ir sheet placed on the Ta target and having a purity of higher than 99.9 weight percent. A plurality of such Ir targets each having a predetermined area are disposed in a predetermined spaced relationship on a surface of the Ta target 206 as denoted by 207 and 208 in FIG. 4. The areas and positions of the individual Ir targets 207 and 208 are determined in accordance with calibration curves produced in accordance with a result of ascertainment which has been made in advance of how a film which contains desired Ir and Ta at a predetermined composition rate can be obtained from a relationship of a ratio of areas of the two targets.

Reference numeral 218 denotes a protective wall for covering over side faces of the Ta target and Ir targets so that they may not be sputtered by plasma from the side faces thereof. Reference numeral 204 denotes a shutter plate provided for horizontal movement such that it cuts off the space between the substrate 203 and the targets at a position above the target holder 205. The shutter plate 204 is used in the following manner. In particular, before starting of film formation, the shutter plate 204 is moved to a position above the target holder 205 on which the Ta target and Ir targets are carried, and then inert gas such as argon (Ar) gas is introduced into the inside of the film forming chamber 201 by way of a gas supply pipe 212. Then, an RF power is applied from an RF power source 215 to convert the gas into plasma so that the Ta target and Ir targets are sputtered by the plasma thus produced to remove impurities from surfaces of the individual targets. After then, the shutter plate 204 is moved to another position (not shown) at which it does not interfere with film formation.

The RF power source 215 is electrically connected to a surrounding wall of the film forming chamber 201 by way of a conductor 216, and it is electrically connected also to the target holder 205 by way of another conductor 217. Reference numeral 214 denotes a matching box.

A mechanism (not shown) for internally circulating cooling water so that the Ta target and Ir targets may be maintained at a predetermined temperature during film formation is provided on the target holder 205. An exhaust pipe 210 for exhausting air from within the film forming chamber is provided for the film forming chamber 201, and the exhaust pipe is communicated with a vacuum pump (not shown) by way of an exhaust valve 211. Reference numeral 202 denotes a gas supply pipe for introducing sputtering gas such as argon gas (Ar gas) or helium gas (He gas) into the film forming chamber 201. Reference numeral 213 denotes a flow rate adjusting valve for sputtering gas provided for the gas supply pipe. Reference numeral 209 denotes an insulating porcelain-clad interposed between the target holder 205 and a bottom wall of the film forming chamber 201 for electrically isolating the target holder 205 from the film forming chamber 201. Reference numeral 219 denotes a vacuum gage provided for the film forming chamber 201. An internal pressure of the film forming chamber 201 is detected automatically by the vacuum gage.

While the apparatus shown in FIG. 4 is of the form wherein only one target holder is provided as described above, a plurality of target holders may otherwise be provided. In this instance, the target holders are arranged in an equally spaced relationship on concentric circles at locations opposing to the substrate 203 in the film forming chamber 201. Then, individually independent RF power sources are electrically connected to the individual target holders by way of individual matching boxes. In the case of the arrangement described above, since two kinds of targets, that is, an Ir target and a Ta target, are used, the two target holders are disposed in the film forming chamber 201 as described above, and the targets are individually placed on the respective target holders. In this instance, since predetermined RF powers can be applied to the individual targets independently of each other, the composition rate of the film forming elements for the film formation can be varied to form a film wherein one or both of the elements of Ir and Ta are varied in the film thicknesswise direction.

Production of the individual samples using the apparatus shown in FIG. 4 was performed in the following film forming conditions except that, each time a sample was to be produced, placement of the Ir targets 207 and 208 on the surface of the Ta target 206 was performed with reference to calibration curves prepared in advance for a non-single crystalline substance (film) having a predetermined composition rate of Ir and Ta to be obtained.

Substrates placed on the substrate holder 202: Si single crystalline substrate of a 4 inch $\phi$ size (manufactured by Wacker) (one piece) and Si single crystalline substrate of a 4 inch $\phi$ size having a $SiO_2$ film of 2.5 um thick formed thereon (manufactured by Wacker)(-three pieces)

Substrate set temperature 50° C.

Base pressure: $2.6\times10^{-4}$ Pa or less

High frequency (RF) power: 1,000 W

Sputtering gas and gas pressure: argon gas, 0.4 Pa

Film forming time: 12 minutes

An electron probe microanalysis was performed to effect a component analysis of some of those of the samples obtained in such a manner as described above which were produced each by forming a film on a substrate with a $SiO_2$ film using EPM-810 manufactured by Kabushiki Kaisha Shimazu Seisakusho, and then those samples which were produced each by forming a film on a Si single crystalline substrate were observed for crystalline structure by means of an X-ray diffraction meter (commodity name: $MXP^3$) manufactured by Mac Science. Subsequently, using some of those of the remaining samples which were produced each by forming a film on a substrate with a $SiO_2$ film, a so-called pond test was conducted for observing a resisting property to an electrochemical reaction and a resisting property to a mechanical shock, and further, using the remaining ones of the samples which were produced each by forming a film on a substrates with a $SiO_2$ film, a step stress test (SST) was conducted for observing a heat resistor property and a shock resisting property in the air. The pond test mentioned above was conducted by a similar technique as in a "bubble resisting test in low conductivity ink" which will be hereinafter described except that, as liquid for the immersion, liquid was used consisting of sodium acetate dissolved by 0.15 weight percent in solution consisting of 70 weight parts of water and 30 weight parts of diethylene glycol. The SST mentioned above was conducted by a technique similar to that of a "step stress test" which will be hereinafter described. The following results were obtained by a synthetic examination of results of the pond obtained by a synthetic examination of results of the pond test and results of the SST. In particular, it became clear with most preferable samples that each of them consists for the most part of a polycrystalline substance and also contains a substance consisting of a polycrystalline substance and an amorphous substance in a mixed condition and also an amorphous substance. Subsequently, when a composition rate of Ir and Ta was investigated with samples within a preferable range, it was found out that they include 35 to 77 atom percent of Ir and 23 to 65 atom percent of Ta. Similarly, as regards samples within a more preferable range, it was found out that they include 42 to 77 atom percent of Ir and 23 to 58 atom percent of Ta. Further, as regards the samples within the most preferable range, it was found out that they include 42 to 77 atom percent of Ir and 23 to 40 atom percent of Ta.

From the results described above, the inventors ascertained that a non-single crystalline Ir-Ta substance containing Ir and Ta as essential components at the respective composition rates given below is suitable for use for a heat generating resistor of an ink jet head:

$$35 \text{ atom } \% \leqq Ir \leqq 77 \text{ atom } \%, \text{ and}$$

$$23 \text{ atom } \% \leqq Ta \leqq 65 \text{ atom } \%.$$

Further, the inventors made heat generating resistors using such non-single crystalline Ir-Ta substances and clear.

In particular, where any of the non-single crystalline Ir-Ta substances is employed, an ink jet head having a heat generating resistor can be obtained which is superior not only in cavitation resisting property and erosion resisting property but also in electrochemical and chemical stability and heat resisting property. Particularly, an ink jet head can be obtained of the construction wherein a heat generating portion of a heat generating resistor contacts directly with ink in an ink pathway. In a head of the construction, since heat energy produced from the heat generating section of the heat generating resistor can act directly upon the ink, the heat transfer efficiency to the ink is high. Therefore, the power consumption by the heat generating resistor can be restricted low, and the rise of temperature of the head (temperature variation of the head) can be reduced significantly. Consequently, occurrence of a density variation in an image by a temperature variation of the head can be eliminated. Besides, a further high responsibility to a discharging signal applied to the heat generating resistor can be obtained.

Further, with a heat generating resistor according to the present invention, a desired specific resistance can be obtained with a high controllability such that a dispersion in resistance in a single head can be reduced very small. Accordingly, an ink jet head can be obtained which can effect significantly stabilized discharging of ink comparing with a prior art arrangement and is superior also in durability.

An ink jet head having such superior characteristics as described above is very suitable to achieve high speed recording of a high image quality involved in increase of discharging outlets.

DETAILED DESCRIPTION OF PREFERRED FORMS

Figure 1A:
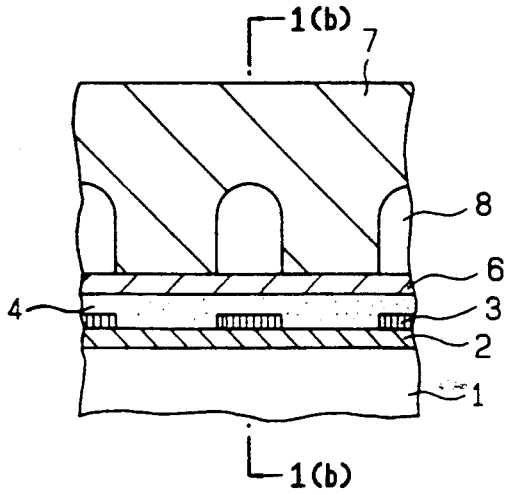
FIG. 1(*a*) is a schematic front elevational view of an essential part of an example of an ink jet head of the present invention as viewed from a discharging outlet side, FIG. 1(*b*) is a schematic sectional view taken along alternate long and short dash line 1(*b*) of FIG. 1(*a*), FIG. 1(*c*) is a schematic plan view of a base member for an ink jet head at a stage at which a layer of a heat generating resistor and electrodes are provided, and FIG. 1(*d*) is a schematic plan view of the base member for an ink jet head at another stage at which a protective layer 6 is provided on those layers.
Figure 1B:
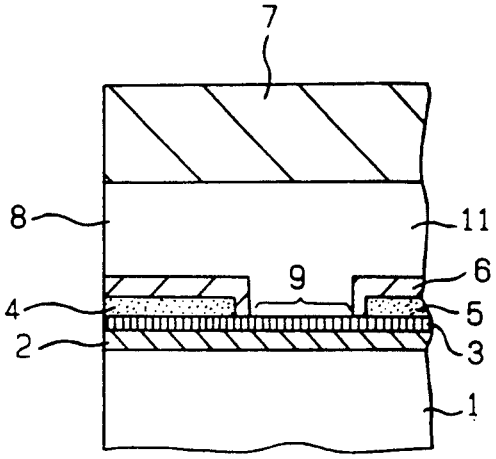
Figure 1C:
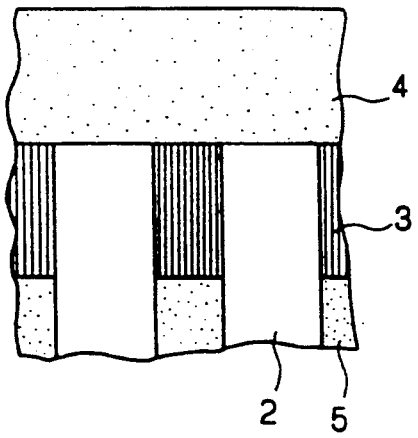
Figure 1D:
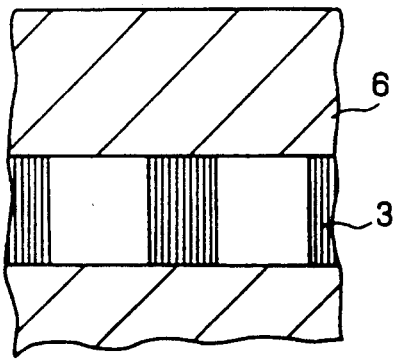

Accordingly, one form of the present invention provides an ink jet head which includes an electrothermal converting body having a heat generating resistor which generates, upon energization, heat energy to be directly applied to ink on a heat acting face to discharge the ink, characterized in that the heat generating resistor is formed from a non-single crystalline substance substantially composed of Ir and Ta and containing such Ir and Ta at the following respective composition rates:

$$35 \text{ atom percent} \leqq Ir \leqq 77 \text{ atom percent, and}$$

23 atom percent ≦ Ta ≦ 65 atom percent.

Another aspect of the present invention provides an ink jet head which includes an electrothermal converting body having a heat generating resistor which generates, upon energization, heat energy to be directly applied to ink on a heat acting face to discharge the ink, characterized in that the heat generating resistor is formed from a non-single crystalline substance substantially composed of Ir and Ta and containing such Ir and Ta at the following respective composition rates:

42 atom percent ≦ Ir ≦ 77 atom percent, and 23 atom percent ≦ Ta ≦ 58 atom percent.

A further aspect of the present invention provides an ink jet head which includes an electrothermal converting body having a heat generating resistor which generates, upon energization, heat energy to be directly applied to ink on a heat acting face to discharge the ink, characterized in that the heat generating resistor is formed from a non-single crystalline substance substantially composed of Ir and Ta and containing such Ir and Ta at the following respective composition rates:

60 atom percent ≦ Ir ≦ 77 atom percent, and 23 atom percent ≦ Ta ≦ 40 atom percent.

In the present invention, while reasons why such various remarkable effects as described hereinabove are achieved where a heat generating resistor for an ink jet head is formed from any of the specific non-single crystalline Ir-Ta substances described above, it is imagined that one of the reasons is that Ir which is superior in heat resisting property, oxidation resisting property and chemical stability prevents a reaction; Ta provides a mechanical strength and brings about a dissolution resisting property; and coexistence of the two elements at the specific composition rates make the stress optimum and increases the adhesion and toughness.

The inventors have confirmed by way of an experiment that, where a heat generating resistor for an ink jet head is formed using a non-single crystalline Ir-Ta substance other than the specific non-single crystalline Ir-Ta substances described above (that is, amorphous Ir-Ta alloy, polycrystalline Ir-Ta alloy or mixture of the alloys), the following problems are presented.

In particular, such heat generating resistor is not optimum in cavitation resisting property, erosion resisting property, electrochemical stability, chemical stability, heat resisting property, adhesion, internal stress and so forth, and where it is used as a heat generating resistor for an ink jet head, particularly as a heat generating resistor of the type wherein it directly contacts with ink, sufficient durability is not obtained. For example, where the amount of Ir is excessively great, exfoliation of a film sometimes takes place, and on the contrary where the amount of Ta is excessively great, the resistor variation sometimes becomes great.

In the present invention, since a heat generating resistor is formed from one of the specific non-single crystalline Ir-Ta substances described above, there is no necessity of provision of a protective film, and an ink jet head can be constructed to be of the type wherein a heat generating portion of the heat generating resistor contacts directly with ink in an ink pathway. Then, the ink jet head according to the present invention is free from the problems which can be seen with the conventionally proposed ink jet heads which have a heat generating resistor which contacts directly with ink, but has the following various advantages which cannot be forecast from the prior art. In particular, (i) it is superior in cavitation resisting property, erosion resisting property, mechanical durability, chemical stability, electrochemical stability, resistance stability, heat resisting property, oxidation resisting property, dissolution resisting property and thermal shock resisting property and has a superior heat conductivity; (ii) whatever type recording liquid (that is, ink) is employed, the ink jet head transmits heat energy efficiently to the recording liquid to effect discharging of the ink to produce a superior record image in quick response to an on demand signal always with stability even after a repetitive use for a long period of time; and then, (iii) the power consumption by the heat generating resistor is restricted low to minimize the temperature variation of the head, and even after a repetitive use for a long period of time, the ink jet head carries out discharging of ink always with stability to produce an image which is free from a density variation by a temperature variation of the head.

In a preferred form of an ink jet head according to the present invention, a heat generating resistor thereof is formed from any of the specific polycrystalline Ir-Ta substances described above and is constructed in a form wherein a heat generating portion of the heat generating resistor contacts directly with ink in an ink pathway. In this instance, the condition stability and the resistance stability are particularly prominent.

While the thickness of a layer of the heat generating resistor in the present invention is determined suitably so that suitable heat energy may be produced effectively, preferably it is 300 Å to 1 μm, and more preferably, it is 1,000 Å to 5,000 Å from the point of durability or characteristics in production and so forth.

Further, in the present invention, while a heat generating resistor formed from any of the specific non-single crystalline Ir-Ta substances described above is normally of the form of a single layer structure, it may otherwise be of the form of a multi-layer structure in some cases. Further, with regard to a layer constituting a heat generating resistor and made of any of the non-single crystalline Ir-Ta substances, it is not always necessary that the composition of the two elements composing the substance, that is, Ir and Ta, be uniform over the entire area of the layer. In particular, one or both of the two elements may be distributed non-uniformly in the thicknesswise direction of the layer so far as the composition rate of the individual elements of Ir and Ta remains within any of the specific ranges described hereinabove. For example where a heat generating resistor is of the form of a single layer structure, the non-single crystalline Ir-Ta substance which forms the layer may be formed such that one of the components thereof is distributed at a comparatively high rate in a region of the layer adjacent a base member for the ink jet head.

On the other hand, a heat generating resistor is made in a two layer structure wherein two layers of a non-single crystalline Ir-Ta substance are layered and one of the two layers which is positioned adjacent a base member for the ink jet head is constituted such that one of the components is distributed at a comparatively high rate in a region of the layer adjacent the base member.

Further, while generally a surface or the inside of a layer is sometimes oxidized upon touching with the atmospheric air or in a procedure of production, the effects of a material according to the present invention are not deteriorated by such little oxidation of a surface or the inside of the material. As such an impurity, at least one element selected, for example, from, beginning with O by oxidation described above, C, N, Si, B, Na, Cl and Fe can be cited.

In addition, a heat generating resistor according to the present invention can be formed, for example, by a DC sputtering method wherein individual materials are piled up simultaneously or alternately, an RF sputtering method, an ion beam sputtering method, a vacuum deposition method, a CVD method, or a film forming method wherein application and baking of paste containing organic metal, or the like are performed.

Subsequently, an ink jet head according to the present invention which employs an alloy material having any of the compositions described above as a heat generating resistor and is superior in thermal efficiency, signal responsibility and so forth will be described with reference to the drawings.

FIG. 1(*a*) is a schematic front elevational view of a principal portion of an example of an ink jet head of the present invention as viewed from a discharging outlet side; and FIG. 1(*b*) is a schematic sectional view taken along alternate long and short dash line 1(*b*) in FIG. 1(*a*).

The ink jet head of the present example has a basic construction wherein an electrothermal converting body having a layer 3 for heat generating resistors having a predetermined shape and electrodes 4 and 5 is formed on a support body which includes a lower layer 2 provided on a surface of a substrate 1, and a protective layer 6 for covering at least the electrodes 4 and 5 of the electrothermal converting body is layered, and besides a grooved plate 7 having recessed portions for providing liquid pathways 11 communicating with discharging outlets 8 is joined over the protective layer 6.

The electrothermal converting body of the present example has the heat generating resistor 3, electrodes 4 and 5 connected to the heat generating resistor 3, and protective layer 6 provided in accordance with the necessity. Meanwhile, a base member for the ink jet head has the support body having the substrate 1 and the lower layer 2, the electrothermal converting body, and the protective layer 6. In the case of the head of the present example, a heat acting face 9 which transmits heat directly to ink is substantially same as a face of a portion (heat generating portion) of the heat generating resistor 3 which is disposed between the electrodes 4 and 5 and contacts with ink, and corresponds to a portion of the heat generating portion which is not covered with the protective film 6.

The lower layer 2 is provided in accordance with the necessity and has a function of adjusting the amount of heat to escape to the substrate 1 side and transmitting heat generated by the heat generating portion efficiently to ink.

The electrodes 4 and 5 are electrodes for energizing the layer 3 of the heat generating resistor to cause heat to be generated from the heat generating portion, and in the present example, the electrode 4 is a common electrode to individual heat generating portions while the electrode 5 is a selecting electrode for individually energizing each of the heat generating portions.

The protective layer 6 is provided in accordance with the necessity for preventing the electrodes 4 and 5 from contacting with and being chemically corroded by ink or preventing the electrodes from being short-circuited by way of ink.

It is to be noted that FIG. 1(*c*) is a schematic plan view of the base member for an ink jet heat at a stage wherein the layer 3 and electrodes 4 and 5 of the heat generating resistor are provided. Meanwhile, FIG. 1(*d*) is a schematic plan view of the base member for an ink jet at another stage wherein the protective layer 6 is provided on the layers of them.

In the present ink jet head, since an alloy material of any of the compositions described above is employed for the layer 3 of the heat generating resistor, while the ink jet head has a construction wherein the ink and the heat acting face 9 contact directly with each other, it has a good durability. In this manner, where a construction is employed wherein a heat generating portion of a heat generating resistor serving as a heat energy source contacts directly with ink, heat generated by the heat generating portion can be transmitted directly to the ink, and very efficient heat transmission can be achieved comparing with an ink jet head of another construction wherein heat is transmitted to ink by way of a protective layer or the like.

As a result, the power consumption by the heat generating resistor can be restricted low, and also the degree in rise of temperature of the head can be reduced. Further, the responsibility to an input signal (discharging instruction signal) to the electrothermal converting body is improved, and a bubble producing condition necessary for discharging can be obtained stably.

Figure 2:
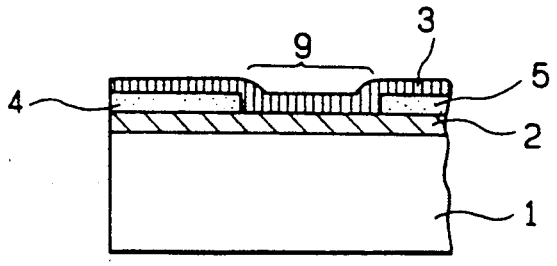
FIG. 2 is a schematic sectional view showing another example of a base member for use with an ink jet head according to the present invention.

Construction of an electrothermal converting body having a heat generating resistor formed using an alloy material according to the present invention is not limited to the example of FIG. 1 but may have various forms, for example, such a construction as shown in FIG. 2.

The base member for an ink jet head having the construction of FIG. 2 does not require provision of a protective layer for an electrode because the electrodes 4 and 5 are covered with the layer 3 of the heat generating resistor of the alloy material of any of the compositions described hereinabove.

Figure 3A:
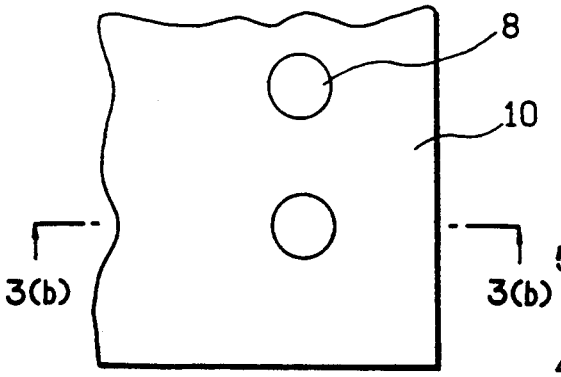
FIG. 3(*a*) and 3(*b*) are a schematic top plan view and a sectional view, respectively, individually showing other examples of an ink jet head according to the present invention.
Figure 3B:
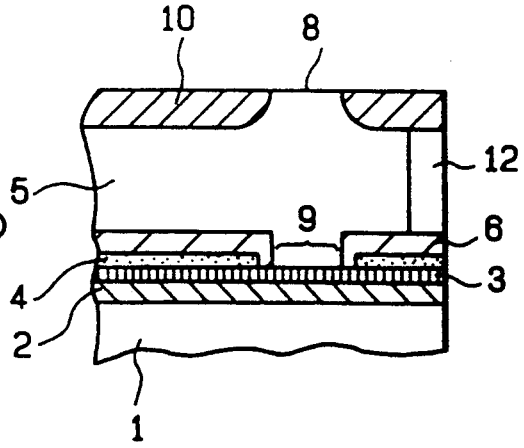

Further, also the construction of the discharging outlet and liquid pathway of the ink jet head is not limited to such construction as shown in FIGS. 1(*a*) and 1(*b*) wherein the direction in which ink is supplied to the heat acting face 9 and the direction in which ink is discharged from the discharging outlet 8 making use of heat energy generated from the heat generating portion are substantially the same, but may be of another construction wherein the directions are different from each other. For example, it is possible to employ such a construction as shown in FIGS. 3(*a*) and 3(*b*) wherein the two directions make a substantially right angle, or the like. Reference numeral 10 in FIG. 3 denotes a plate (discharging outlet plate) of a suitable thickness in which discharging outlets are provided, and reference numeral 12 denotes a support wall member for supporting the discharging outlet plate thereon.

While an ink jet head of the present invention may be formed such that an ink discharging structure unit having a discharging outlet, a liquid pathway and a heat generating portion may be provided by a plural number as shown in FIG. 1 or 3, particularly from the reasons described hereinabove, the present invention is particularly effective where such ink discharging units are disposed in such a high density as, for example, 8 units per mm or more, or further, 12 units per mm or more.

As an example which has a plurality of ink discharging structure units, for example, an ink jet head of a so-called full line type can be cited which has a construction wherein the ink discharging structure units are arranged over the full width of a printing area of a record medium.

In the case of such a so-called full line head of the form wherein a discharging outlet is provided by a plural number corresponding to the width of a recording area of a record medium, or in other words, in the case of a head wherein 1,000 or more or 2,000 or more discharging outlets are arranged, a dispersion of resistances of individual heat generating portions in the one head has an influence upon the uniformity in volume of droplets to be discharged from the discharging outlets, which will sometimes make a cause of non-uniformity in density of an image. However, with a heat generating resistor according to the present invention, since a desired specific resistance can be obtained with a high controllability such that a dispersion in resistance in a single head can be reduced very small, the problems described above can be eliminated with a remarkably good condition.

In this manner, a heat generating resistor according to the present invention has a progressively increasing significance in such a tendency that an increase in speed of recording (for example, a printing speed of 30 cm/sec or more, or further, 60 cm/sec or more) and an increase in density are further demanded and the number of discharging outlets of a head is increased correspondingly.

Further, in such an ink jet head of the form as disclosed in U.S. Pat. No. 4,429,321 wherein a functioning element is structurally provided in the inside of a surface of a head base member, it is one of important points to form an electric circuit for the entire head accurately in accordance with its designing to cause a function of the functioning element to be maintained correct, and a heat generating resistor according to the present invention is very effective also in this meaning. This is because an electric circuit for the entire head can be formed accurately in accordance with its designing since, with a heat generating resistor according to the present invention, a desired specific resistance can be obtained with a high controllability such that a dispersion in resistance in a single head can be reduced very small.

In addition, a heat generating resistor according to the present invention is very effective also for an ink jet head of a disposable cartridge type which integrally includes an ink tank for storing therein ink to be supplied to a heat acting face. This is because, while it is required for an ink jet head of the form that the running cost of an entire ink jet apparatus in which the head is mounted be low, since the heat generating resistor according to the present invention can be constructed such that it contacts directly with ink as described hereinabove, the heat transfer efficiency to the ink can be made high, and therefore, the power consumption of the entire apparatus can be reduced and it can be achieved readily to meet the requirement described above.

By the way, it is also possible to cause an ink jet head of the present invention to have a form wherein a protective layer is provided on a heat generating resistor. In such instance, an ink jet head can be obtained which is further superior with regard to a durability of an electrothermal converting body and a resistance variation of the heat generating resistor by an electrochemical reaction while the heat transfer efficiency to ink is sacrificed more or less. From such point of view, when a protective layer is provided, it is preferable to restrict the overall thickness of the layer within the range of 1,000 Å to 5 μm. As a protective layer, particularly a protective layer which has a Si containing insulating layer provided on a heat generating resistor and made of $SiO_2$, SiN or the like and a Ta layer provide on the Si containing insulating layer in such a manner as to form a heat acting face is cited as a preferable example.

Further, an ink jet head of the present invention is not limited for the generation of heat energy to be utilized for the discharging of ink but may be utilized as a heater for heating a desired portion in the head which is provided in accordance with the necessity, and it is used particularly suitably where such heater contacts directly with ink.

By mounting an ink jet head of the construction described so far on an apparatus body and applying a signal from the apparatus body to the head, an ink jet recording apparatus can be obtained which can effect high speed recording and high image quality recording.

Figure 5:
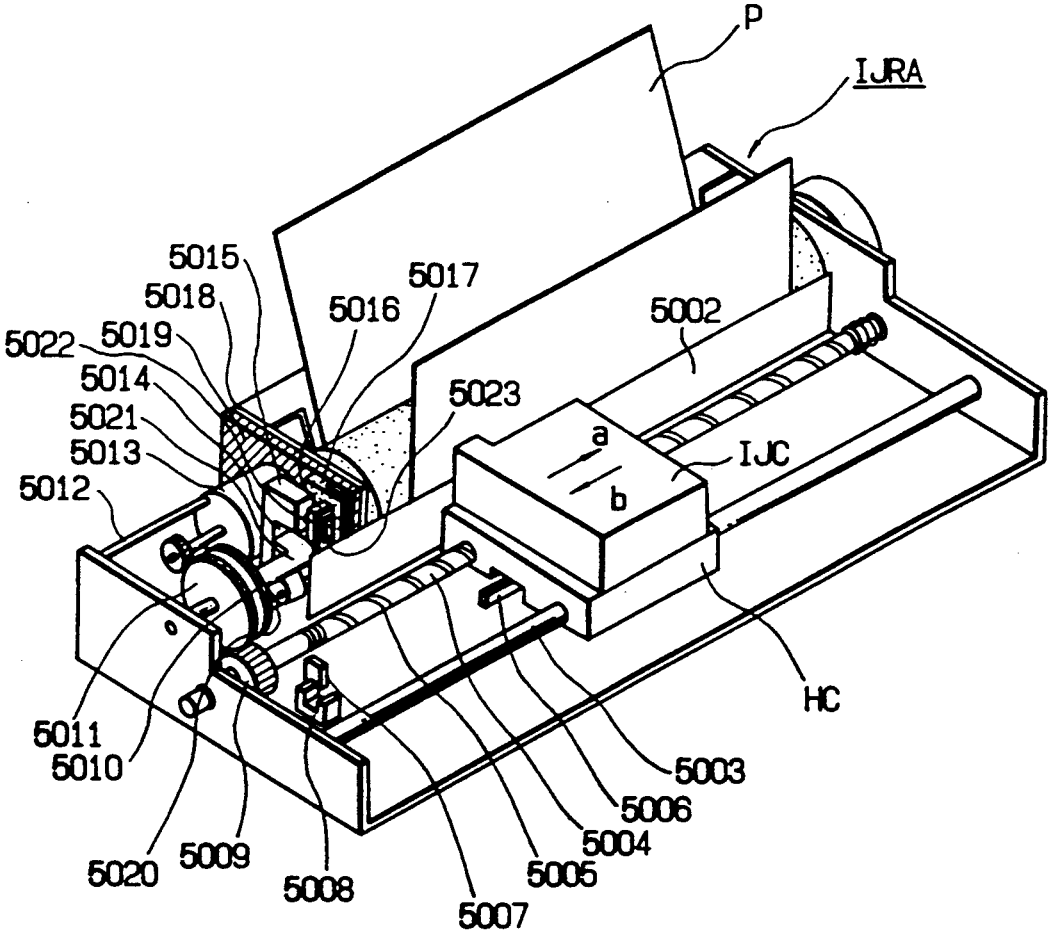
FIG. 5 is an appearance perspective view showing an example of an ink jet apparatus according to the present invention.

FIG. 5 is an appearance perspective view showing an example of an ink jet recording apparatus IJRA to which the present invention is applied, and a carriage HC held in engagement with a spiral groove 5004 of a lead screw 5005 which is rotated by way of driving force transmitting gears 5011 and 5009 in response to forward or rearward rotation of a drive motor 5013 has a pin (not shown) and is moved back and forth in the directions of arrow marks a and b. Reference numeral 5002 denotes a paper holding plate, which presses paper against a platen 5000 over the direction of movement of the carriage. Reference numerals 5007 and 5008 denote a photocoupler, which is home position detecting means for confirming presence of a lever 5006 of the carriage in this region to effect reversal of the direction of rotation or the like of the motor 5013. Reference numeral 5016 denotes a member for supporting thereon a cap member 5022 provided for capping a front face of a recording head IJC of a cartridge type on which an ink tank is provided integrally, and reference numeral 5015 denotes sucking means for sucking the inside of the cap, and the sucking means 5015 effects sucking restoration of the recording head by way of an opening 5023 in the cap. Reference numeral 5017 denotes a cleaning blade, and 5019 denotes a member for making the blade possible to move in backward and forward directions. The members 5017 and 5019 are supported on a body supporting plate 5018. Not the blade of this form but a well known cleaning blade can naturally be applied to the present example. Meanwhile, reference numeral 5012 denotes a lever for starting sucking for the sucking restoration, and the lever 5012 is moved upon movement of a cam 5020 which engages with the carriage and driving force from the drive motor is controlled for movement by known transmitting means such as changing over of a clutch. A CPU for supplying a signal to an electrothermal converting body provided in the ink jet head IJC or executing driving control of the various mechanisms described above is provided on the apparatus body side (not shown).

It is to be noted that portions other than the above described heat generating resistor of the ink jet head and ink jet apparatus of the present invention can be formed using known materials and methods.

EXAMPLES

In the following, the present invention will be described more in detail in accordance with examples.

EXAMPLE 1

Figure 4:
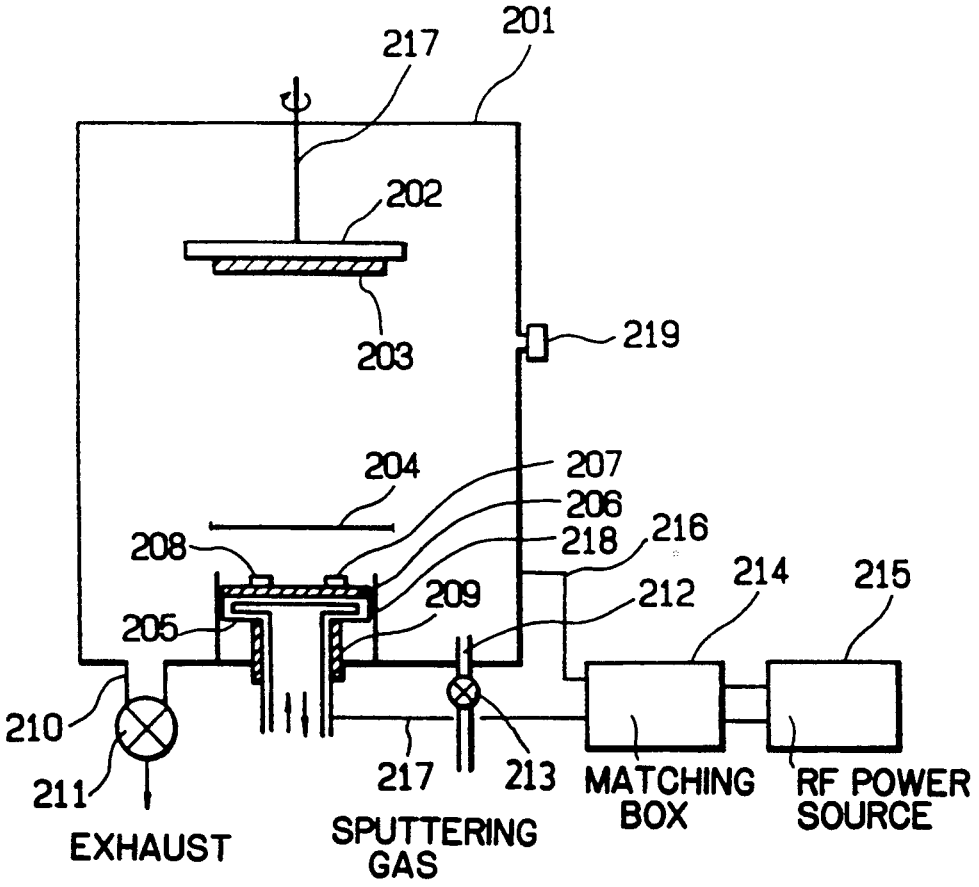
FIG. 4 is a schematic sectional view showing an example of a high frequency sputtering apparatus which is used to produce a film of a heat generating resistor or the like according to the present invention.

A Si single crystalline substrate (by Wacker) and another Si single crystalline substrate (by Wacker) having a $SiO_2$ film of 2.5 μm thick formed on a surface thereof were set in position as sputtering substrates 203 for sputtering on the substrate holder 202 in the film forming chamber 201 of the high frequency sputtering apparatus shown in FIG. 4 and described hereinabove, and using a composite target including Ir sheets 207 and 208 of a high purity higher than 99.9 weight percent placed on a Ta target 206 made of a raw material of a similar purity, sputtering was performed in the following conditions to form an alloy layer of a thickness of about 2,000 Å.

Sputtering Conditions

| | |
|---|---|
| Target area ratio | Ta:Ir = 94:16 |
| Target area | 5 inch (127 mm) ϕ |
| High frequency power | 1,000 W |
| Substrate set temperature | 50° C. |
| Film forming time | 12 minutes |
| Base pressure | $2.6 \times 10^{-4}$ Pa or less |
| Sputtering gas pressure | 0.4 Pa (argon) |

Further, for the substrate with a $SiO_2$ film on which the alloy layer was formed, the composite target was subsequently replaced by another Al target, and an Al layer which was to make electrodes 4 and 5 was formed with a layer thickness of 6,000 Å on the alloy layer in accordance with an ordinary method by sputtering, thereby completing sputtering.

After then, photoresist was formed twice in a predetermined pattern by a photo-lithography technique, and the alloy layer was dry etched first by wet etching of the Al layer and for the second time by ion milling to form heat generating resistors 3 and electrodes 4 and 5 of such shapes as shown in FIGS. 1(*b*) and 1(*c*). The size of a heat generating portion was 30 μm×170 μm while the pitch of heat generating portions was 125 μm, and a group wherein up to 24 such heat generating sections were arranged in a row was formed by a plural number on the substrate with a $SiO_2$ film described hereinabove.

Subsequently, a $SiO_2$ film was formed on the substrate with a $SiO_2$ film by sputtering, and after then, the $SiO_2$ film was patterned, using a photolithography technique and reactive ion etching, in such a manner as to cover over portions of 10 μm wide on the opposite sides of the heat generating portions and the electrodes to produce a protective layer 6. The size of the heat acting portions 9 was 30 μm×150 μm.

The product in such condition was subjected to cutting operation for each of the groups to produce a large number of base members for an ink jet head, and an evaluation test which will be hereinafter described was conducted with some of the base members for an ink jet head.

Meanwhile, a groove plate 7 made of glass was joined to each of some of the remaining products in order to form discharging outlets 8 and liquid pathways 11 shown in FIGS. 1(*a*) and 1(*b*) to obtain ink jet heads.

The ink jet heads thus obtained were mounted on a recording apparatus of a known construction, and recording operation was performed. Thus, recording was performed with a high discharging stability in a high signal responsibility, and an image of a high quality was obtained. Also, the durability of them on the apparatus against use was high.

(1) Analysis of Film Composition

An EPMA (electron probe microanalysis) was conducted for heat acting portions having no protective films thereon in the following conditions using the measuring instrument described hereinabove to effect a composition analysis of materials.

| | |
|---|---|
| Acceleration voltage | 15 kV |
| Probe diameter | 10 μm |
| Probe current | 10 nA |

Results of the analysis are indicated in Table 1 below.

It is to be noted that a quantitative analysis was conducted only for principal components of targets as raw materials but not for argon which is normally taken in a film by sputtering. Further, it was confirmed by simultaneous employment of a qualitative analysis and a quantitative analysis that other impurity elements of any sample were lower than a detection tolerance (about 0.2 weight percent) of the analyzing apparatus).

(2) Measurement of Film Thickness

Measurement of film thickness was conducted by step measurement using a contour measuring instrument of the tracer type (alpha-step 200 by TENCOR INSTRUMENTS).

Results of the measurement are indicated in Table 1.

(3) Measurement of Crystalline Structure of Film

An X-ray diffraction pattern was measured for the samples on which alloy films were formed on the Si single crystalline substrate, using the measuring instrument described above, and the samples were classified into three types including crystalline ones (C) with which an acute peak by crystal was seen, those (A) which did not provide an acute peak and were considered to be in an amorphous condition, and those (M) in which the two are present in a mixed condition.

Results of the measurement are indicated in Table 1.

(4) Measurement of Specific Resistance of Film

A specific resistance was calculated from the film thickness and a sheet resistance which was measured using a 4-probe resistance meter (K-705RL by Yugen Kaisha Kyowariken).

Results are indicated in Table 1.

(5) Measurement of Density of Film

A variation in weight of the substrate before and after formation of a film was measured using an ultra-micro balance produced by INABA SEISAKUSHO LTD., and a density was calculated from a value of the measurement and an area and a thickness of the film.

Results are indicated in Table 1.

(6) Measurement of Internal Stress of Film

A warp was measured for two elongated glass substrates before and after formation of the film, and an internal stress was found out by a calculation from an amount of such variation and a length, thickness, Young's modulus, Poisson's ratio and film thickness.

Results are indicated in Table 1.

(7) Bubble Endurance Test in Low Electric Conductivity Ink

The devices (base members for an ink jet head) obtained precedently at a stage at which no discharging ports nor liquid pathways were formed were immersed, at portions at which the protective layer 6 was provided, into low electric conductivity ink (clear ink) described below, and a rectangular wave voltage having a width of 7 μsec and a frequency of 5 kHz was applied from an external power source across the electrodes 4 and 5 while gradually raising the voltage to obtain a bubble production treshold voltage ($V_{th}$).

| Ink Composition | |
|---|---|
| Water | 70 weight parts |
| Diethylene glycol | 30 weight parts |
| Ink electric conductivity | 25 μS/cm |

Subsequently, a pulse voltage equal to 1.1 times the voltage $V_{th}$ was applied in the ink to repeat production of bubbles to measure a number of application pulses until each of the 24 heat acting portions 9 was brought into a broken condition, and an average value of them was calculated (such bubble endurance test in ink will be hereafter called commonly as "pond test"). The values of the results of the measurement obtained are indicated in Table 1 as relative values (the column "clear" of "pond test" of Table 1) relative to a reference value provided by an average value of results of measurement in another bubble endurance test which was conducted in low electric conductivity ink in Comparative Example 7 which will be hereinafter described.

It is to be noted that, since the ink of the composition described above is low in electric conductivity, the influence of an electrochemical reaction is low, and a principal factor of break is an erosion or thermal shock by a cavitation. A durability of a heat generating resistor to them can be found out by the present test.

(8) Bubble Endurance Test in High Electric Conductivity Ink

Subsequently, a bubble endurance test was conducted in high electric conductivity ink (black ink here) described below similarly as in the case of (7) above. In this instance, not only a number of application pulses but also a variation in resistance of a heat generating resistor before and after application of a pulse signal were measured.

| Ink Composition | |
|---|---|
| Water | 68 weight parts |
| Diethylene glycol | 30 weight parts |
| Black dyestuff (C.I. Hood Black 2) | 2 weight parts |
| PH conditioner (sodium acetate) | small amount (adjusted to PH 6 to 7) |
| Ink electric conductivity | 2.6 mS/cm |

Values of results of the measurement were calculated as average values in a similar manner as in (7) described above, and values obtained are indicated in Table 1 (column "black" of "pond test" of Table 1) as relative values relative to a reference value provided by an average value of results of measurement which were obtained in a bubble endurance test in high electric conductivity ink in Comparative Example 8 which will be hereinafter described.

It is to be noted that the ink of the composition described above is so high in ink electric conductivity that electric current flows in the ink upon application of a voltage. According to the present test, a condition can be discriminated whether or not an electrochemical reaction provides damage to the heat generating resistor in addition to a shock or erosion by a cavitation. Also here, the test serves as an acceleration test on an actual discharging form.

(9) Step Stress Test (SST)

A step stress test wherein the pulse voltage was successively increased for a fixed step ($6\times10^5$ pulses, 2 minutes) while similar pulse width and frequency as in (7) and (8) were employed was conducted in the air, and a ratio (M) between a break voltage ($V_{break}$) and $V_{th}$ found out in (7) was found out, and a temperature reached by the heat acting face at $V_{break}$ was estimated. Results are indicated in Table 1. It is to be noted that, from the results of the test, a heat resisting property and a thermal shock resisting property of a heat generating resistor in the air can be discriminated.

(10) Evaluation with Actual Ink Jet Head

| (Column of BJ Aptitude of Table 1) Example of printer driving conditions | |
|---|---|
| Discharging outlet number | 24 |
| Driving frequency | 2 kHz |
| Driving pulse width | 10 μsec |
| Driving voltage | 1.2 times the discharging threshold voltage ($V_{th}$) |
| Ink | same as black ink used in pond test |

(i) Print Quality

Printing of characters and so forth was performed using the head, and the printed characters and so forth were visually judged. If very good print was obtained using the ink jet head, then ○ is applied; if good print was obtained, then Δ is applied; and then if a trouble such as no discharging or blurring took place, then X is applied. Results of the evaluation are indicated in Table 1.

(ii) Durability

After printing corresponding to 2,000 pages of the A4 size was carried out with each head using three heads for each of the heat generating resistors, if very good and normal print was obtained with all of the three heads, then ○ is applied; if good and normal print was obtained with all of the three heads, then Δ is applied; and then if a trouble such as a failure took place even with only one of the heat generating resistors of the three head, then X was applied. Results of the evaluation are indicated in Table 1.

(11) Total Evaluation

Total evaluation was conducted based on criteria described below, and results are indicated in Table 1.

◎: Specific resistance ≧ 100 μ cm,
Ratio (relative value)of a result of an endurance test by a pond test in low electric conductivity ink: ≧6,
Ratio (relative value) of a result of an endurance test by a pond test in high electric conductivity ink: ≧3,
Resistance variation: ≦5%, SST M: ≦1.7, and in case both of evaluation results of print quality and durability are both ○.

○: In case the value of SST M of the evaluation item in the case of ◎ above is ≧1.55.

Δ: In case the value of SST M of the evaluation item in the case of ◎ above is ≧1.50.

X : Either in case any one of the specific resistance, result of the pond test in high electric conductivity ink, resistance variation and SST M is evaluated lower than Δ in integrated evaluation, or in case only either one of the print quality and durability is X.

EXAMPLES 2 TO 9

Devices (base members for an ink jet head) and ink jet heads were produced in a similar manner as in Example 1 except that, upon formation of a heat generating resistor, the area ratio of individual raw materials of a sputtering target was changed variously as shown in Table 1. An analysis and evaluation were conducted with each of the thus obtained devices similarly as in Example 1, and results are indicated in Table 1. Further, every one of the ink jet heads produced using those devices had a good recording characteristic and durability.

EXAMPLE 10

The sputtering apparatus used in Example 1 was modified to produce a film forming apparatus which has a plurality of target holders in a film forming chamber and an RF power can be applied to each of the target holders independently of each other. Further, targets of Ta and Ir each having a purity higher than 99.9 weight percent were mounted on two of the target holders of the apparatus so that the two kinds of metals may be sputtered independently of and simultaneously with each other. With the present apparatus, film formation by multi-dimensional simultaneous sputtering was performed in the conditions described below using substrates similar to those used in Example 1.

Sputtering conditions

| Target No. | Substance | Applied Power (W) |
|---|---|---|
| 1 | Ta | 1000 → 500 |
| 2 | Ir | 500 → 1000 |

| | |
|---|---|
| Target area: | each 5 inches (127 mm) ϕ |
| Set substrate temperature: | 50° C. |
| Film forming time: | 9 minutes |
| Base pressure: | $2.6 \times 10^{-4}$ Pa or less |
| Sputtering gas pressure: | 0.4 Pa (Ar) |

The applied voltages to the individual targets were increased continuously as in a linear function with respect to a film formation time.

An analysis and evaluation similar to those as in Example 1 were conducted with films thus obtained, and results are indicated in Table 1. As to composition, film formation was conducted separately in fixed conditions while the initial applied power was kept fixed or the applied power upon completion was kept fixed, and a quantitative analysis by an EPMA was made similarly as in Example 1. Results of the analysis are such as follows:

in case the initial applied voltage was kept fixed:

$$Ta:Ir = 58:42 \quad (1)$$

in case the applied voltage upon completion was kept fixed:

$$Ta:Ir = 25:75 \quad (2)$$

From this, it was presumed that a base member side region and a front surface side region of the formerly obtained film have the compositions of (1) and (2) above, respectively, and the composition from the base member side region to the front surface side region varies continuously from (1) to (2). By varying the composition in the thicknesswise direction in this manner, the adhesion of a film to a base member can be further improved, and the internal stress is controlled desirably.

EXAMPLE 11

Using the same apparatus as was used in Example 10, film formation was performed in similar conditions except that the applied power was changed in such a manner as described below, and an analysis and evaluation similar to those in Example 1 were conducted with devices and ink jet heads thus obtained. Results are indicated in Table 1.

Applied power conditions

| | | Applied Power (W) | |
|---|---|---|---|
| Target No. | Substance | 0 to 4 minutes | 4 to 8 minutes |
| 1 | Ta | 1000 | 500 |
| 2 | Ir | 500 | 1000 |

In this instance, a layered film consisting of two upper and lower layers was obtained, and the compositions of the upper layer and the lower layer were different from each other so that the adhesion of the heat generating resistor to a base member is assured.

EXAMPLES 12 TO 20

Base members for an ink jet head and ink jet heads were produced similarly as in the individual examples described above except that, using the sputtering apparatus of FIG. 4 described hereinabove, $SiO_2$ was sputtered on a layer of a heat generating resistor of each of base members for an ink jet head produced in a similar manner as the base members for an ink jet head produced individually in Examples 1 to 9 to provide a $SiO_2$ protective layer of 1.0 μm thick, and then, Ta was sputtered on the $SiO_2$ protective layer to provide a Ta protective layer of 0.5 μm thick.

An evaluation test was conducted with the thus obtained base members for an ink jet head and ink jet heads similarly as in Example 1. Comparing with any example wherein no protective layer was provided, results of the endurance test by an immersion test (pond test) in ink were improved a little both in the case of low electric conductivity ink and high electric conductivity ink. Further, the resistance variation was decreased comparing with any example wherein no protective layer was provided. However, M of the SST was reduced as a whole.

From the foregoing, it became clear that the products are further improved with regard to such a point as a durability or a resistance variation mainly by an electrochemical reaction by provision of a protective layer.

It is to be noted that the reason why M of the SST was reduced is imagined to be that the bubble production threshold voltage ($V_{th}$) which makes a denominator of M was increased since the heat transfer efficiency to ink was decreased by provision of a protective layer.

Comparative Example 1

A device (base member for an ink jet head) and an ink jet head were produced similarly as in Example 1 except that a Ta target was used as a sputtering target upon formation of a heat generating resistor.

An analysis and evaluation were conducted with the thus obtained device and ink jet head similarly as in Example 1, and results are indicated in Table 1.

Comparative Examples 2 to 7

Devices (base members for an ink jet head) and ink jet heads were produced similarly as in Example 1 except that the area ratio of individual raw materials of a sputtering target upon formation of a heat generating resistor was changed variously as shown in Table 1.

An analysis and evaluation were conducted with the thus obtained devices and ink jet heads similarly as in Example 1, and results are indicated in Table 1.

Comparative Example 8

A device (base member for an ink jet head) and an ink jet head were produced similarly as in Example 1 except that an Al target on which a Ta sheet was provided was used as a sputtering target upon formation of a heat generating resistor, and the area ratio of raw materials of the sputtering target was changed in such a manner as indicated in an item of Comparative Example 8 of Table 2.

An analysis and evaluation were conducted with the thus obtained device and ink jet head in a similar manner as in Example 1, and results are indicated in Table 2.

It is to be noted that a result of a pond test in the present comparative example was used as a reference value for results of the pond tests for the other examples (examples and other comparative examples). In particular, as shown in Table 2, the value of the pond test in the present comparative example was set to 1 both for low electric conductivity ink and high electric conductivity ink. In the present example, the result of the pond test of low electric conductivity ink was about 0.7 times the result of the pond test of high electric conductivity ink.

Comparative Examples 9 to 12

Devices (base members for an ink jet head) and ink jet heads were produced in a similar manner as in Example 1 except that an Al target on which a Ta sheet was provided was used as a sputtering target upon formation of a heat generating resistor and the area ratio of individual raw materials of the sputtering target was varied in such a manner as indicated in Table 2.

An analysis and evaluation were made with the thus obtained devices and ink jet heads similarly as in Example 1, and results are indicated in Table 2.

Comparative Examples 13, 14 and 15

Devices (base members for an ink jet head) and ink jet heads were produced in a similar manner as in Example 1 except that an Al target on which an Ir sheet was provided was used as a sputtering target upon formation of a heat generating resistor and the area ratio of individual raw materials of the sputtering target was varied in such a manner as indicated in Table 3.

An analysis and evaluation were made with the thus obtained devices and ink jet heads similarly as in Example 1, and results are indicated in Table 3.

While the examples of the present invention described above are described using liquid ink, the present invention can employ ink which has a solid state at a room temperature only if it is softened at a room temperature. Since the ink jet apparatus described above commonly effect temperature control such that the temperature of the ink itself is adjusted within a range from 30° C. to 70° C. to maintain the viscosity of the ink within a stable discharging range, any ink is available if it assumes a liquid state when a recording signal is applied thereto. Also use of ink of such a characteristic wherein it is liquidized, either using ink with which a rise of temperature by heat energy is positively prevented by using the heat energy as heat energy for the transformation in form of the ink from a solid state to a liquid state or using ink which is solidified in a stored condition for the object of prevention of evaporation of the ink, only by heat energy as is liquidized and discharged in the form of ink liquid by application of heat energy in response to a recording signal or as begins to be solidified at a point of time at which it arrives at a record medium can be applied to the present invention. In such an instance, the form may be employed wherein the ink is opposed to an electrothermal converting body in a condition wherein it is held in the form of liquid or as a solid substance in a recessed portion of a porous sheet or a through-hole as disclosed in Japanese Patent Laid-Open No. 56847/1979 or Japanese Patent Laid-Open No. 71260/1985. In the present invention, the most effective arrangement to the individual inks described above is an arrangement which executes the film boiling method described above.

A representative construction and principle of a recording head and a recording apparatus of the ink jet type according to the present invention are preferably those which adopt a fundamental principle which is disclosed, for example, in U.S. Pat. No. 4,723,129 or U.S. Pat. No. 4,740,796. While this system can be applied to either of the so-called on demand type and the continuous type, particularly it is effective in the case of the on demand type because, by applying at least one driving signal for providing a rapid temperature rise exceeding nucleate boiling in response to recording information to an electrothermal converting body disposed for a sheet on which liquid (ink) is carried or for a liquid pathway, the electrothermal converting member generates heat energy to cause film boiling at ink on a heat acting face of the recording head and as a result an air bubble can be formed in the liquid (ink) in a one by one corresponding relationship to such driving signal. By such growth and contraction of an air bubble, the liquid (ink) is discharged by way of a discharging outlet to form at least one droplet. If the driving signal has a pulse shape, then growth and contraction of an air bubble take place promptly and appropriately, and consequently, discharging of the liquid (ink) which is superior particularly in responsibility can be achieved, which is further preferable. As a driving signal of such pulse shape, such a driving signal as disclosed in U.S. Pat. No. 4,463,359 or U.S. Pat. No. 4,345,262 is suitable. It is to be noted that further excellent recording can be achieved if such conditions as are described in U.S. Pat. No. 4,313,124 of the invention regarding a rate of temperature rise of the heat acting face are adopted.

As construction of a recording head, in addition to any combination construction (linear liquid flow pathway or perpendicular liquid flow pathway) of such discharging outlets, liquid pathways and electrothermal converting bodies as are disclosed in the individual documents described above, construction which adopts U.S. Pat. No. 4,558,333 or U.S. Pat. No. 4,459,600 which discloses a construction wherein a heat acting portion is disclosed in a curved region is also included in the present invention. In addition, the present invention is effective also for a construction based on Japanese Patent Laid-Open No. 123670/1984 which discloses a construction wherein a slit common to a plurality of electrothermal converting bodies is used as a discharging portion of the electrothermal converting bodies or for another construction based on Japanese Patent Laid-Open No. 138461/1984 which discloses a construction wherein an opening for absorbing a pressure wave of heat energy corresponds to a discharging portion.

Further, as a recording head of the full line type which has a length corresponding to the width of a maximum record medium which can be recorded by a recording apparatus, either one of a construction wherein the length is completed by such a combination of a plurality of recording heads as disclosed in the publications described hereinabove and another construction wherein it is constructed as a single recording head formed as a single block may be employed, and in either case, the present invention can exhibit the effects described above further effectively.

In addition, the present invention is effective also where a recording head of the exchangeable chip type wherein electric connection to an apparatus body or supply of ink from the apparatus body is enabled when it is mounted on the apparatus body or another recording head of the cartridge type wherein an ink tank is provided integrally on the recording head itself is employed.

Further, it is preferable to add restoring means for a recording head or preparatory auxiliary means or the like which is provided as a construction of a recording apparatus of the present invention because the effects of the present invention can be stabilized further. Citing those particularly, capping means, cleaning means, pressurizing or attracting means, preliminary heating means including an electrothermal converting body or a separate heating element or a combination of them, and to employ a preparatory discharging mode in which discharging is performed separately from recording, are also effective to achieve stabilized recording.

Furthermore, the present invention is very effective not only to a recording apparatus which has, as a recording mode, a recording mode of a main color such as black, but also to an apparatus which includes a plurality of different colors or at least one of full colors by color mixture whether a recording head may be constructed as a single block or a combination of a plurality of recording heads may be provided.

If an alloy material according to the present invention is employed, an ink jet head and an ink jet head apparatus can be obtained which include an electrothermal converting body having a heat generating resistor which is superior also in cavitation and error resisting property, electrochemical stability, chemical stability, oxidation resisting property, dissolution resisting property, heat resisting property, thermal shock resisting property, mechanical durability and so forth. Particularly, it is also possible to obtain an ink jet head and an ink jet apparatus of a construction wherein a heat generating portion of a heat generating resistor contacts directly with ink in an ink pathway. In a head and apparatus of the construction, the heat transfer efficiency to ink is high because heat energy generated from the heat generating portion of the heat generating resistor can act directly upon ink. Accordingly, the power consumption by the heat generating resistor can be restricted low and the temperature rise of the head (temperature variation of the head) can be reduced significantly, and consequently, an occurrence of an image density variation by a temperature variation of the head can be avoided. Further, a further high responsibility to a discharging signal applied to the heat generating resistor can be obtained.

Further, with a heat generating resistor according to the present invention, a desired specific resistance can be obtained with a high controllability such that the dispersion in resistance in a single head may be very small.

Accordingly, according to the present invention, an ink jet head and an ink jet apparatus which can effect significantly stabilized discharging of ink and are superior also in durability comparing with conventional apparatus.

An ink jet head and an ink jet apparatus having such excellent characteristics as described above are very suitable for an increase in speed of recording and improvement in image quality involved in an increase of discharging outlets.

TABLE 1

| Example No. Comparative example No. | target area ratio Ta | target area ratio Ir | film composition (atomic %) Ta | film composition (atomic %) Ir | film thickness Å | crystallinity | specific resistance μΩcm | density g/cm³ | internal stress kgf/mm² | pond test clear | pond test black | resistance variation % | SST M | SST temperature °C. | BJ aptitude print quality | BJ aptitude durability | total evaluation |
|---|---|---|---|---|---|---|---|---|---|---|---|---|---|---|---|---|---|
| Comparative example | | | | | | | | | | | | | | | | | |
| 1 | 100 | — | 100 | — | 2080 | C | 181 | 14.3 | −136 | 0.4 | 0.1 | 8.1 | 1.20 | 430 | X | X | X |
| 2 | 94 | 6 | 94 | 6 | 2110 | C | 171 | 15.2 | −157 | 4 | 0.1 | 5.7 | 1.34 | 540 | Δ | X | X |
| 3 | 90 | 10 | 87 | 13 | 2120 | C | 166 | 16.0 | −155 | 4 | 0.1 | 6.3 | 1.38 | 570 | Δ | X | X |
| 4 | 88 | 12 | 75 | 25 | 2180 | C | 170 | 16.7 | −148 | 5 | 0.1 | 5.5 | 1.40 | 590 | Δ | X | X |
| 5 | 86 | 14 | 67 | 33 | 2320 | A | 198 | 16.8 | −58 | 5 | 1 | 7.8 | 1.47 | 650 | Δ | X | X |
| Example | | | | | | | | | | | | | | | | | |
| 1 | 84 | 16 | 65 | 35 | 2340 | A | 199 | 16.8 | −66 | 9 | 3 | 4.8 | 1.50 | 680 | ○ | Δ | Δ |
| 2 | 81 | 19 | 58 | 42 | 2420 | A | 206 | 17.0 | −38 | 8 | 4 | 4.4 | 1.55 | 720 | ○ | ○ | ○ |
| 3 | 78 | 22 | 50 | 50 | 2200 | A | 219 | 17.3 | −24 | 12 | 5 | 4.9 | 1.58 | 750 | ○ | ○ | ○ |
| 4 | 75 | 25 | 49 | 51 | 2260 | A | 226 | 17.1 | −41 | 17 | 7 | 4.4 | 1.55 | 680 | ○ | ○ | ○ |
| 5 | 72 | 28 | 46 | 54 | 2320 | A | 237 | 17.0 | −36 | 18 | 6 | 2.1 | 1.59 | 760 | ○ | ○ | ○ |
| 6 | 68 | 32 | 40 | 60 | 2250 | A | 233 | 18.4 | −11 | 22 | 8 | 4.3 | 1.72 | 890 | ○ | ○ | ◎ |
| 7 | 59 | 41 | 31 | 69 | 2560 | C | 172 | 18.6 | −215 | 15 | 7 | 1.8 | 1.75 | 920 | ○ | ○ | ◎ |

TABLE 1-continued

| Example No. | target area ratio Ta | target area ratio Ir | film composition (atomic %) Ta | film composition (atomic %) Ir | film thickness Å | crystallinity | specific resistance μΩcm | density g/cm³ | internal stress kgf/mm² | pond test clear | pond test black | resistance variation % | SST M | SST temperature °C. | BJ aptitude print quality | BJ aptitude durability | total evaluation |
|---|---|---|---|---|---|---|---|---|---|---|---|---|---|---|---|---|---|
| 8 | 55 | 45 | 27 | 73 | 2620 | C | 168 | 18.6 | −185 | 15 | 6 | 1.6 | 1.75 | 920 | ○ | ○ | ◎ |
| 9 | 50 | 50 | 23 | 77 | 2800 | C | 127 | 18.8 | −210 | 8 | 4 | 1.5 | 1.75 | 920 | ○ | ○ | ◎ |
| 10 | — | — | — | — | 3000 | M | 190 | 17.4 | −77 | 14 | 6 | 4.4 | 1.73 | 900 | ○ | ○ | ◎ |
| 11 | — | — | — | — | 2620 | M | 154 | 17.9 | −152 | 12 | 5 | 3.7 | 1.75 | 920 | ○ | ○ | ◎ |
| Comparative example | | | | | | | | | | | | | | | | | |
| 6 | 46 | 54 | 21 | 79 | 2890 | C | 121 | 19.0 | −238 | 2 | 1 | 1.7 | 1.52 | 690 | Δ | X | X |
| 7 | 37 | 63 | 12 | 88 | 3020 | C | 78 | 19.0 | −210 | film removal was found | | | | | X | X | X |

TABLE 2

| Comparative example No. | target area ratio Al | target area ratio Ta | film composition (atomic %) Al | film composition (atomic %) Ta | film thickness Å | crystallinity | specific resistance μΩcm | internal stress kgf/mm² | pond test clear | pond test black | resistance variation % | SST M | SST temperature °C. | BJ aptitude print quality | BJ aptitude durability | total evaluation |
|---|---|---|---|---|---|---|---|---|---|---|---|---|---|---|---|---|
| Comparative example | | | | | | | | | | | | | | | | |
| 8 | 65 | 35 | 74 | 26 | 3720 | C | 156 | −47 | 1 | 1 | 7.5 | 1.45 | 630 | Δ | X | X |
| 9 | 55 | 45 | 50 | 50 | 2720 | A | 251 | −61 | 4 | 2 | 7.2 | 1.40 | 590 | Δ | X | X |
| 10 | 50 | 50 | 45 | 55 | 2520 | A | 245 | −21 | 4 | 2 | 9.4 | 1.40 | 590 | Δ | X | X |
| 11 | 40 | 60 | 28 | 72 | 2220 | C | 187 | −134 | 5 | 2 | 9.3 | 1.44 | 620 | Δ | X | X |
| 12 | 35 | 65 | 21 | 79 | 2340 | C | 194 | −115 | 5 | 2 | 11.3 | 1.35 | 550 | Δ | X | X |

TABLE 3

| Comparative example No. | target area ratio Al | target area ratio Ir | film composition (atomic %) Al | film composition (atomic %) Ir | film thickness Å | crystallinity | specific resistance μΩcm | internal stress kgf/mm² | pond test clear | pond test black | resistance variation % | SST M | SST temperature °C. | BJ aptitude print quality | BJ aptitude durability | total evaluation |
|---|---|---|---|---|---|---|---|---|---|---|---|---|---|---|---|---|
| Comparative example | | | | | | | | | | | | | | | | |
| 13 | 84 | 16 | 80 | 20 | 4120 | A | 503 | −22 | 0.0 | 0.0 | — | — | — | X | X | X |
| 14 | 72 | 28 | 58 | 42 | 3580 | M | 351 | −94 | 5 | 0.2 | 5.1 | 1.42 | 600 | Δ | X | X |
| 15 | 68 | 32 | 51 | 49 | 3350 | C | 240 | −157 | 0.0 | 0.0 | — | — | — | X | X | X |

Note: The expression "0.0" means a negligible ratio.

We claim:

1. An ink jet head which includes an electrothermal converting body having a heat generating resistor which generates, upon energization, heat energy to be directly applied to ink on a heat acting face to discharge the ink, characterized in that said heat generating resistor is formed from a non-single crystalline material consisting essentially of Ir and Ta at the following respective composition rates:

35 atom percent ≦ Ir ≦ 77 atom percent, and 23 atom percent ≦ Ta ≦ 65 atom percent.

2. An ink jet head according to claim 1, wherein the respective composition rates of the Ir and Ta contained in the composing material of said heat generating resistor are such as follows:

42 atom percent ≦ Ir ≦ 77 atom percent, and 23 atom percent ≦ Ta ≦ 58 atom percent.

3. An ink jet head according to claim 1, wherein the respective composition rates of the Ir and Ta contained in the composing material of said heat generating resistor are such as follows:

60 atom percent ≦ Ir ≦ 77 atom percent, and 23 atom percent ≦ Ta ≦ 40 atom percent.

4. An ink jet head according to claim 1, wherein said non-single crystalline substance is a polycrystalline substance.

5. An ink jet head according to claim 1, wherein said non-single crystalline substance is an amorphous substance.

6. An ink jet head according to claim 1, wherein said non-single crystalline substance is a substance consisting of a polycrystalline substance and an amorphous substance in a mixed condition.

7. An ink jet head according to claim 1, wherein the material forming said heat generating resistor contains, as an impurity or impurities, at least one element selected from the group including O, C, N, Si, B, Na, Cl and Fe.

8. An ink jet according to claim 1, wherein the material forming said heat generating resistor has a distributed condition of contained elements which varies in the thicknesswise direction of said heat generating resistor.

9. An ink jet head according to claim 1, wherein said heat generating resistor has a structure wherein a plurality of layers are layered.

10. An ink jet head according to claim 1, wherein said electrothermal converting body has a pair of electrodes disposed on said heat generating resistor and held in contact with the layer of said heat generating resistor to effect the energization.

11. An ink jet heat according to claim 1, wherein said electrothermal converting body has a pair of electrodes disposed under said heat generating resistor and held in contact with the layer of said heat generating resistor to effect the energization.

12. An ink jet head according to claim 1, wherein said heat acting face is formed from said heat generating resistor.

13. An ink jet head according to claim 1, wherein said heat acting face is formed from a protective layer on said heat generating resistor.

14. An ink jet head according to claim 1, wherein said protective layer has a Ta layer forming said heat acting face, and a Si containing insulating layer interposed between said Ta layer and said heat generating resistor.

15. An ink jet head according to claim 1, wherein the thickness of the layer of said heat generating resistor ranges from 300 Å to 1 μm.

16. An ink jet head according to claim 15, wherein the thickness of the layer of said heat generating resistor ranges from 1,000 Å to 5,000 Å.

17. An ink jet head according to claim 1, wherein the direction in which ink is discharged is substantially same as the direction in which ink in supplied to said heat acting face.

18. An ink jet head according to claim 1, wherein the direction in which ink is discharged is substantially perpendicular to the direction in which ink is supplied to said heat acting face.

19. An ink jet head according to claim 1, wherein a discharging outlet for discharging ink therefrom is provided by a plural number corresponding to the width of a recording area of a record medium.

20. An ink jet head according to claim 19, wherein said discharging outlet is provided by a number equal to 1,000 or more.

21. An ink jet head according to claim 20, wherein said discharging outlet is provided by a number equal to 2,000 or more.

22. An ink jet head according to claim 1, wherein said ink jet head is a head of the type wherein a functioning element which participates in discharging of ink is provided structurally in the inside of a surface of a head base member.

23. An ink jet head according to claim 1, wherein said ink jet head is a head of the disposable cartridge type which integrally includes an ink tank for storing therein ink to be supplied to said heat acting face.

24. An ink jet apparatus according which includes an electrothermal converting body having a heat generating resistor which generates, upon energization, heat energy to be directly applied to ink on a heat acting face to discharge the ink, and means for supplying a single to said electrothermal converting body, characterized in that said heat generating resistor is formed from a non-single crystalline material consisting essentially of Ir and Ta at the following respective composition rates:

35 atom percent ≦ Ir ≦ 77 atom percent, and 23 atom percent ≦ Ta ≦ 65 atom percent.

25. An ink jet apparatus according to claim 24, which effects color recording.

26. An ink jet apparatus according to claim 24 which further includes a carriage capable of moving means having the electrothermal converting body therein.

* * * * *

UNITED STATES PATENT AND TRADEMARK OFFICE

CERTIFICATE OF CORRECTION

PATENT NO. : 5,142,308

DATED : August 25, 1992

INVENTOR(S) : KENJI HASEGAWA, ET AL.

It is certified that error appears in the above-identified patent and that said Letters Patent is hereby corrected as shown below:

COLUMN 7

Line 59, "substances and" should read --substances.--.
Line 60, "clear." should be deleted.

COLUMN 10

Line 54, "example" should read --example,--.

COLUMN 14

Line 9, "provide" should read --provided--.

COLUMN 17

Line 6, "treshold" should read --threshold--.

COLUMN 22

Line 4, "in form of the ink" should read --in the form of ink--.
Line 29, "particularly" should read --particularly,--.

UNITED STATES PATENT AND TRADEMARK OFFICE

CERTIFICATE OF CORRECTION

PATENT NO. : 5,142,308

DATED : August 25, 1992

INVENTOR(S) : KENJI HASEGAWA, ET AL.

It is certified that error appears in the above-identified patent and that said Letters Patent is hereby corrected as shown below:

COLUMN 28

Line 31, "according" should be deleted.
Line 49, "claim 24" should read --claim 24,--.

Signed and Sealed this

Twelfth Day of October, 1993

Bruce Lehman

*Attest:*

BRUCE LEHMAN

*Attesting Officer*

*Commissioner of Patents and Trademarks*